US008471667B2

(12) United States Patent
Gardner et al.

(10) Patent No.: US 8,471,667 B2
(45) Date of Patent: Jun. 25, 2013

(54) ON-DIE MICRO-TRANSFORMER STRUCTURES WITH MAGNETIC MATERIALS

(75) Inventors: Donald S. Gardner, Mountain View, CA (US); Peter Hazucha, Beaverton, OR (US); Gerhard Schrom, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 47 days.

(21) Appl. No.: 12/955,415

(22) Filed: Nov. 29, 2010

(65) Prior Publication Data

US 2011/0068887 A1 Mar. 24, 2011

Related U.S. Application Data

(63) Continuation of application No. 10/430,508, filed on May 5, 2003, now Pat. No. 7,852,185.

(51) Int. Cl.
*H01F 5/00* (2006.01)

(52) U.S. Cl.
USPC ..... 336/200

(58) Field of Classification Search
USPC ..... 336/65, 83, 200, 232; 257/531
See application file for complete search history.

(56) References Cited

U.S. PATENT DOCUMENTS

| | | | |
|---|---|---|---|
| 3,607,462 | A | 9/1971 | Laing |
| 3,881,244 | A | 5/1975 | Kendall |
| 3,905,883 | A | 9/1975 | Hanazono et al. |
| 4,543,553 | A | 9/1985 | Mandai et al. |
| 4,791,719 | A | 12/1988 | Kobayashi et al. |
| 4,797,648 | A | 1/1989 | Kaneko et al. |
| 4,816,784 | A | 3/1989 | Rabjohn |
| 4,884,156 | A | 11/1989 | Miyakawa et al. |
| 4,959,631 | A | 9/1990 | Hasegawa et al. |
| 5,047,296 | A | 9/1991 | Miltenberger et al. |
| 5,053,697 | A | 10/1991 | Carnel et al. |
| 5,095,357 | A | 3/1992 | Andoh et al. |
| 5,121,852 | A | 6/1992 | Wilkes |
| 5,169,713 | A | 12/1992 | Kumurdjian |
| 5,221,459 | A | 6/1993 | Okano et al. |
| 5,298,857 | A | 3/1994 | Voisine et al. |
| 5,420,558 | A | 5/1995 | Ito et al. |
| 5,446,311 | A | 8/1995 | Ewen et al. |

(Continued)

FOREIGN PATENT DOCUMENTS

| | | |
|---|---|---|
| DE | 4117878 | 12/1991 |
| EP | 0295028 A1 | 12/1988 |

(Continued)

OTHER PUBLICATIONS

"Taiwan Application Serial No. 93107741, Notice of Allowance mailed Apr. 29, 2010", 3 pgs.

(Continued)

*Primary Examiner* — Tuyen Nguyen
(74) *Attorney, Agent, or Firm* — Schwegman, Lundberg & Woessner, P.A.

(57) ABSTRACT

Some embodiments include a die having a transformer. The transformer includes windings formed from a set of lines, such that no two lines belonging to any one winding are nearest neighbors. The lines are formed within one layer on the die. Other embodiments are described.

20 Claims, 6 Drawing Sheets

U.S. PATENT DOCUMENTS

| | | | | |
|---|---|---|---|---|
| 5,469,399 | A | 11/1995 | Sato et al. | |
| 5,530,415 | A | 6/1996 | Takaya et al. | |
| 5,583,474 | A | 12/1996 | Mizoguchi et al. | |
| 5,609,946 | A | 3/1997 | Korman et al. | |
| 5,635,892 | A | 6/1997 | Ashby et al. | |
| 5,694,030 | A | 12/1997 | Sato et al. | |
| 5,696,441 | A | 12/1997 | Mak et al. | |
| 5,705,287 | A | 1/1998 | Doerner et al. | |
| 5,781,071 | A | 7/1998 | Kusunoki | |
| 5,801,100 | A | 9/1998 | Lee et al. | |
| 5,834,825 | A | 11/1998 | Imai | |
| 5,877,533 | A | 3/1999 | Arai et al. | |
| 5,892,425 | A | 4/1999 | Kuhn et al. | |
| 5,920,979 | A | 7/1999 | Nepela et al. | |
| 5,930,415 | A | 7/1999 | Pham | |
| 5,952,704 | A | 9/1999 | Yu et al. | |
| 5,961,746 | A | 10/1999 | Nepela | |
| 5,976,715 | A | 11/1999 | Chen et al. | |
| 6,031,445 | A | 2/2000 | Marty et al. | |
| 6,033,782 | A | 3/2000 | Hubbard et al. | |
| 6,037,649 | A | 3/2000 | Liou | |
| 6,040,226 | A | 3/2000 | Wojnarowski et al. | |
| 6,043,641 | A | 3/2000 | Singer et al. | |
| 6,067,002 | A | 5/2000 | Fujino et al. | |
| 6,103,136 | A | 8/2000 | Han | |
| 6,114,937 | A | 9/2000 | Burghartz et al. | |
| 6,121,852 | A | 9/2000 | Mizoguchi et al. | |
| 6,166,422 | A | 12/2000 | Qian et al. | |
| 6,191,495 | B1 | 2/2001 | Kossives et al. | |
| 6,194,987 | B1 | 2/2001 | Zhou et al. | |
| 6,201,287 | B1 | 3/2001 | Forbes | |
| 6,207,303 | B1 | 3/2001 | Tomita | |
| 6,240,621 | B1 | 6/2001 | Nellissen et al. | |
| 6,281,560 | B1 | 8/2001 | Allen et al. | |
| 6,291,305 | B1 | 9/2001 | Huang et al. | |
| 6,392,524 | B1 | 5/2002 | Biegelsen et al. | |
| 6,404,317 | B1 | 6/2002 | Misoguchi et al. | |
| 6,414,564 | B1 | 7/2002 | Mizoguchi et al. | |
| 6,433,299 | B1 | 8/2002 | Varshney | |
| 6,441,715 | B1 | 8/2002 | Johnson | |
| 6,452,247 | B1 | 9/2002 | Gardner | |
| 6,583,620 | B2 * | 6/2003 | Honda et al. | 324/252 |
| 6,593,841 | B1 | 7/2003 | Mizoguchi et al. | |
| 6,597,593 | B1 | 7/2003 | Cruz et al. | |
| 6,838,863 | B2 | 1/2005 | Hazucha et al. | |
| 6,856,228 | B2 | 2/2005 | Gardner | |
| 6,870,456 | B2 | 3/2005 | Gardner | |
| 6,891,461 | B2 | 5/2005 | Gardner | |
| 7,208,963 | B2 | 4/2007 | Schrom et al. | |
| 7,852,185 | B2 | 12/2010 | Gardner et al. | |
| 2001/0052837 | A1 | 12/2001 | Walsh | |
| 2003/0001709 | A1 | 1/2003 | Visser | |
| 2003/0001713 | A1 | 1/2003 | Gardner | |
| 2004/0246226 | A1 | 12/2004 | Moon | |
| 2006/0091896 | A1 | 5/2006 | Schrom et al. | |
| 2007/0001762 | A1 | 1/2007 | Schrom et al. | |

FOREIGN PATENT DOCUMENTS

| | | | |
|---|---|---|---|
| EP | 0725407 | A1 | 8/1996 |
| EP | 0884783 | A2 | 12/1998 |
| FR | 2369694 | | 5/1978 |
| JP | 61020311 | | 1/1986 |
| JP | 3214411 | | 9/1991 |
| JP | 5081615 | | 4/1993 |
| JP | 6124843 | | 5/1994 |
| JP | 7272932 | | 10/1995 |
| JP | 2000082621 | | 3/2000 |
| TW | 378417 | | 1/2000 |
| TW | 386310 | | 4/2000 |
| TW | 411481 | | 11/2000 |
| WO | WO-0139220 | A1 | 5/2001 |
| WO | WO-02065492 | A2 | 8/2002 |

OTHER PUBLICATIONS

"Office Action", Taiwan Application No. 93111253, 2 pgs.

"Response filed Jun. 1, 2006 to Office Action", Taiwan Application No. 93111253, 9 pgs.

Baba, M., "GHz-Drive Magnetic Thin-Film Inductor Using CoNbZr Film", Journal of the Magnetics Society of Japan, 24(4-2), (2000), 879-882.

Brandon, E., "Microinductors for Sacecraft Power Eectronics", 6th International Symposium, Magnetic Materials, Processes and Device VI Applications to Storage and Microelectromechanical systems (MEMS), vol. 2000-29, The Electrochemical Society, Inc., Pennington, New Jersey, (2001), 559-567.

Fessant, A., et al., "Influence of In-Plane Anisotropy and Eddy Currents on the Frequency Spectra of the Complex Permeability of Amorphous CoZr Thin Films", IEEE Transactions on Magnetics, 29(1), (Jan. 1993), 82-87.

Gardner, D., "High Frequency (GHz) and Low Resistance Integrated Inductors Using Magnetic Materials", Proceedings of the IEEE 2001 International Interconnect Technology Conference, (Jun. 2001), 101-103.

Gardner, D. S., "Integrated Transformer", U.S. Appl. No. 09/813,496, filed Mar. 21, 2001, 51 pgs.

Gardner, D. S., "Integrated Transformer", U.S. Appl. No. 09/853,370, filed May 11, 2001, 62 pgs.

Gardner, D., "Mechanical Stress as a Function of Temperature for Aluminum Alloy Films", Journal of Applied Physics, 67(4), (Feb. 15, 1990), 1831-1845.

Kobayashi, Y, "New Type Micro Cloth-Inductor and Transformer With Thin Amorphous Wires and Multi-Thin Coils", IEEE Transactions on Magnetics, 28(5), (Sep. 1992), 3012-3014.

Koniklijke Philips Electronics, "Current Sensing Power MOSFETs Rev 01.00-09", (09 09 04).

Korenivski, V., "Magnetic Film Inductors for Radio Frequency Applications", Journal of Applied Physics, 82(10), (Nov. 15, 1997), 5247-5254.

Long, J., "The Modeling, Characterization, and Design of Monolithic Inductors for Silicon RF IC's", IEEE Journal of Solid-State Circuits, 32(2), (Mar. 1997), 357-369.

Matsuki, H., "A New Cloth Inductor Using Amorphous Fiber", IEEE Transactions on Magnetics, 21(5), (Sep. 1985), 1738-1740.

Matsumoto, S., "Integration of a Power Supply for System-on-Chip", IEICE Transactions on Fundamentals of Electronics, Communications and Computer Sciences, vol. E80-A, No. 2, (Feb. 1997), 276-282.

Mino, M., et al., "A New Planar Microtransformer for Use in Micro-Switching Converters", IEEE Transactions on Magnetics, 28(4), (Jul. 1992), 1969-1973.

Mino, M., et al., "Planar Microtransformer With Monolithically-Integrated Rectifier Diodes for Micro-Switching Converters", IEEE Transactions on Magnetics, vol. 32(2), (Mar. 1996), 291-296.

Mohan, S., "Bandwidth Extension in CMOS With Optimized On-Chip Inductors", IEEE Journal of Solid-State Circuits, 35(3), (2000), 346-355.

Mohan, S., "Simple Accurate Expressions for Planar Spiral Inductances", IEEE Journal of Solid-State Circuits, 34(10), (Oct. 1999), 1419-1424.

Niknejad, A., "Analysis, Design, and Optimization of Spiral Inductors and Transformers Si RF IC's", IEEE Journal of Solid-State Circuits, 33(10), (Oct. 1998), 1470-1481.

O'Donnell, T., "Microtransformers and Inductors using Permalloy Thin Films", Preparation, Properties, and Applications of Thin Ferromagnetic Films, http://www.iemw.tuwien.ac.at/publication/workshop0600/ODonnell.html, (Jun. 2000), 45-52.

Oshiro, O., et al., "A Novel Miniature Planar Inductor", IEEE Transactions on Magnetics, vol. Mag-23, No. 5, (1987), 3759-3761.

Park, J. Y., et al., "Batch-Fabricated Microinductors With Electroplated Magnetically Anisotropic and Laminated Alloy Cores", IEEE Transactions on Magnetics, 35(5), (Sep. 1999), 4291-4300.

Sato, T., "New Applications of Nanocrystalline Fe(Co-Fe)Hf-O Magnetic Films to micromagnetic devices", Journal of Applied Physics, 83(11), (Jun. 1, 1998), 6658-6660.

Shirakawa, K., "Thin Film Cloth-Structured Inductor for Magnetic Integrated Circuit", IEEE Transactions on Magnetics, 26(5), (Sep. 1990), 2262-2264.

Tomita, H., "Oblique-field annealing effect for in-plane magnetic anisotropy of soft magnetic Co-Nb-Zr thin films", IEEE Transactions on Magnetics, 30(3), (May 1994), 1336-1339.

Yabukami, S., "Noise Analysis of a MHz-3 GHz Magnetic Thin Film Permeance Meter", Journal of Applied Physics, 85(8), (Apr. 15, 1999), 5148-5150.
Yamaguchi, M., "1 GHz-drive magnetic thin-film inductors for RF integrated circuits using micro-patterned granular film", Digest of INTERMAG 99. 1999 IEEE International Magnetics Conference, 1999, (May 18-21, 1999), ED01-ED01.
Yamaguchi, M., "Chapter 5. Magnetic Films for Planar Inductive Components and Devices", In: Handbook of Thin Film Devices, vol. 4—Magnetic Thin Film Devices, Francombe, M. H., Editor, (2000), 185-212.
Yamaguchi, M., "Characteristics of Magnetic Thin-Film Inductors at Large Magnetic Field", IEEE Transactions on Magnetics, 31(6), (Nov. 1995), 4229-4231.
Yamaguchi, M., "Magnetic Thin-Film Inductor for RF Integrated Circuits", Extended Abstracts of the 1999 International Conference on Solid-State Devices and Materials, Tokyo, (1999), 580-581.
Yamaguchi, M., "Microfabrication and Characteristics of Magnetic Thin-Film Inductors in the Ultra High Frequency Region", Journal of Applied Physics, 85(11), (Jun. 1, 1999), 7919-7922.
Yue, C., "On-Chip Spiral Inductors With Patterned Ground Shields for Si-Based RF IC's", IEEE Jorunal of Solid-State Circuits, 33(5), (May 1998), 743-752.
Zommer, N., et al., "Power current mirror devices and their applications", Proc. Power convers. Int. Conf. Jun. 1986, (1986), 275-283.

* cited by examiner

ON-DIE MICRO-TRANSFORMER STRUCTURES WITH MAGNETIC MATERIALS

PRIORITY APPLICATION

This application is a continuation of U.S. application Ser. No. 10/430,508, filed May 5, 2003 now U.S. Pat. No. 7,852,185, which is incorporated herein by reference in its entirety.

FIELD

The present invention relates to transformers, and more particularly, to transformers that may be integrated on a die.

BACKGROUND

Transformers are used in many different types of power distribution systems, such as in switched voltage converters. An example of a switched voltage converter utilizing a transformer is the diagonal half-bridge flyback converter of FIG. 1. In a first portion of a switching cycle, both transistors 102 and 104 are ON and store energy in the magnetic field of transformer 106. All the diodes are OFF, i.e., reverse-biased. In a second (flyback) portion of a switching cycle, the energy previously stored in the transformer magnetic field is released to output capacitor 108 via output diode 110. Any excess energy will be returned to input capacitor 112 via input diodes 114 and 116, which also limits the voltage stress on switching transistors 102 and 104. The duty cycle depends on the transformer turn ratio (i.e. voltage conversion ratio). Controller 118 adjusts the switching frequency to regulate the amount of energy provided to load 120, so that the sensed voltage VS is close to reference voltage Vref. For a small load, the switching frequency is high. For a large load, the switching frequency is low. The coupling factor between the input and output windings of transformer 106 determines how much of the stored magnetic energy is released to the output in the second (flyback) portion of switching cycle. Low coupling factor results in poor efficiency.

The flyback converter of FIG. 1 is just one example of a switched voltage converter making use of a transformer. In many applications requiring a DC-to-DC converter, such as portable systems utilizing microprocessors, switched voltage converters may be more desirable than other types of voltage converters or regulators, such as linear voltage regulators, because they can be made more efficient. In a linear voltage regulator, the power conversion efficiency is always less than VS/VD, whereas in a switching converter, the efficiency is typically 80-95%.

Transformers find applications in power distribution systems other than the flyback converter, which is just one example. There are advantages to integrating a power distribution system on the same die as the circuits that are powered by the power distribution system. For example, as processor technology scales to smaller dimensions, supply voltages to circuits within a processor will also scale to smaller values. But for many processors, power consumption has also been increasing as technology progresses. Using an off-die voltage converter to provide a small supply voltage to a processor with a large power consumption leads to a large total electrical current being supplied to the processor. This can increase the electrical current per pin, or the total number of pins needed. Also, an increase in supply current can lead to an increase in resistive as well as inductive voltage drop across various off-die and on-die interconnects, and to a higher cost for decoupling capacitors. Integrating the voltage converter onto the die would mitigate these problems because a higher input voltage with lower current could be provided to the die by an off-die power supply, and the reduction of the higher input voltage to lower, regulated voltages could be done on the die closer to the circuits that require the regulated voltages.

DESCRIPTION OF EMBODIMENTS

Figure 1:
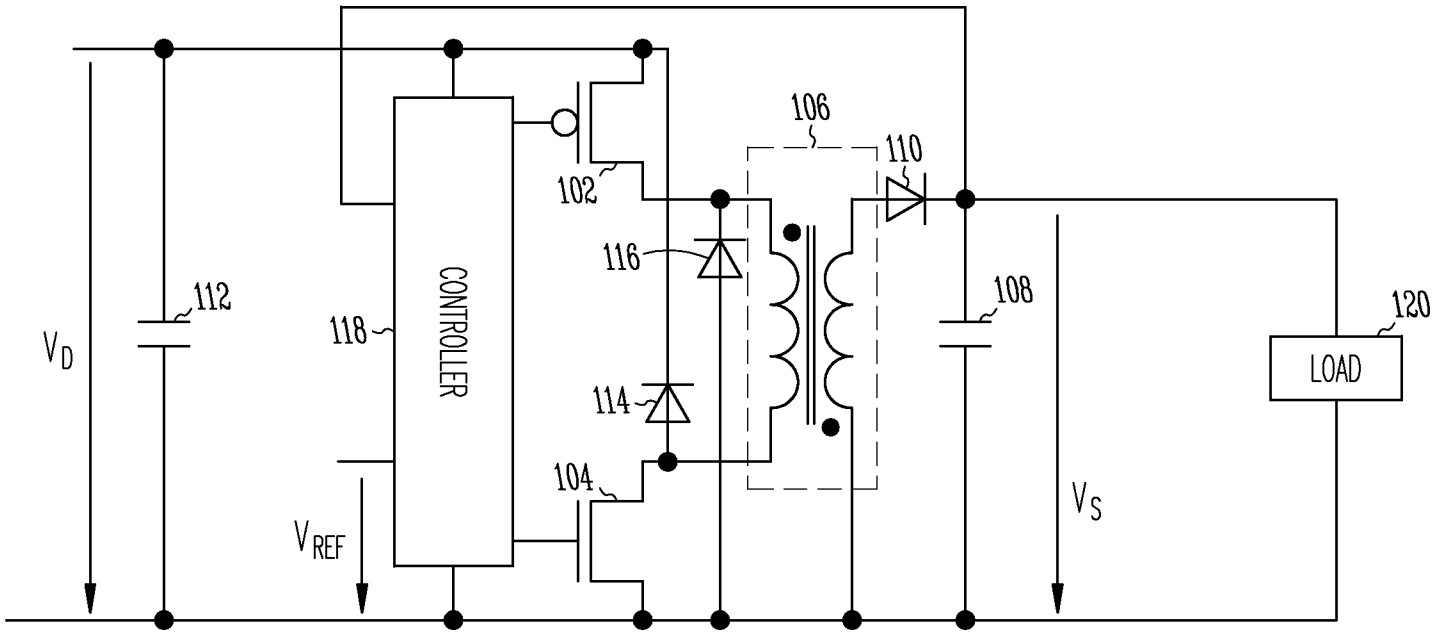
Fig. 1 (Prior Art)
FIG. 1 is a diagonal half-bridge flyback converter.
Figure 2:
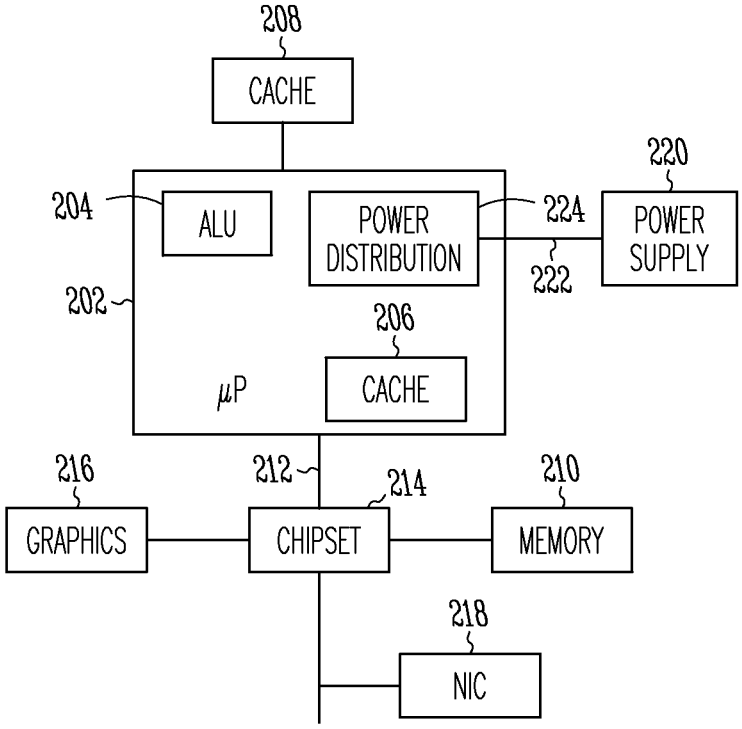
FIG. 2 is a computer system utilizing an embodiment of the present invention.

Embodiments of the present invention may be integrated on a processor, or used in computer systems, such as that shown in FIG. 2. In FIG. 2, microprocessor die 202 comprises many sub-blocks, such as arithmetic logic unit (ALU) 204 and on-die cache 206. Microprocessor 202 may also communicate to other levels of cache, such as off-die cache 208. Higher memory hierarchy levels, such as system memory 210, are accessed via host bus 212 and chipset 214. In addition, other off-die functional units, such as graphics accelerator 216 and network interface controller (NIC) 218, to name just a few, may communicate with microprocessor 202 via appropriate busses or ports.

Power supply 220 provides an input supply voltage to on-die power distribution system 224 via power bus 222. Power supply 220 may provide power to other modules, but for simplicity such connections are not shown. Embodiments of the present invention provide transformers that may be utilized in on-die power distribution system 224.

For a transformer to be small enough to be integrated on a die, it is proposed that its operating frequency, for example the frequency of controller 108, be sufficiently high and that magnetic material suitable for high frequency operation be used to increase coupling between the windings of the transformer. For some embodiments, it is proposed that the magnetic material is chosen from the group consisting of amorphous CoZrTa, CoFeHfO, CoAlO, FeSiO, CoFeAlO, CoNbTa, CoZr, and other amorphous cobalt alloys. An amorphous alloy used in a particular embodiment may comprise various atomic percentages of its constituent elements. For example, a particular embodiment using the amorphous cobalt alloy CoZrTa may have 4% Zr, 4.5% Ta, with the rest being Co. For some other embodiments using CoZrTa, the range for Zr may be from 3% to 12% and the range for Ta may be from 0% to 10%. Other embodiments may use the cobalt alloy CoFeHfO, with 19.1% Fe, 14.5% Hf, and 22.1% O, or the Cobalt alloy CoFeAlO, with 51.1% Co, 21.9% Fe, and 27% Al. These merely serve as particular examples. The use of such magnetic material allows for operating frequencies of 10 MHz to 1 GHz, and higher. However, other magnetic material may be used in other embodiments.

Figure 3A:
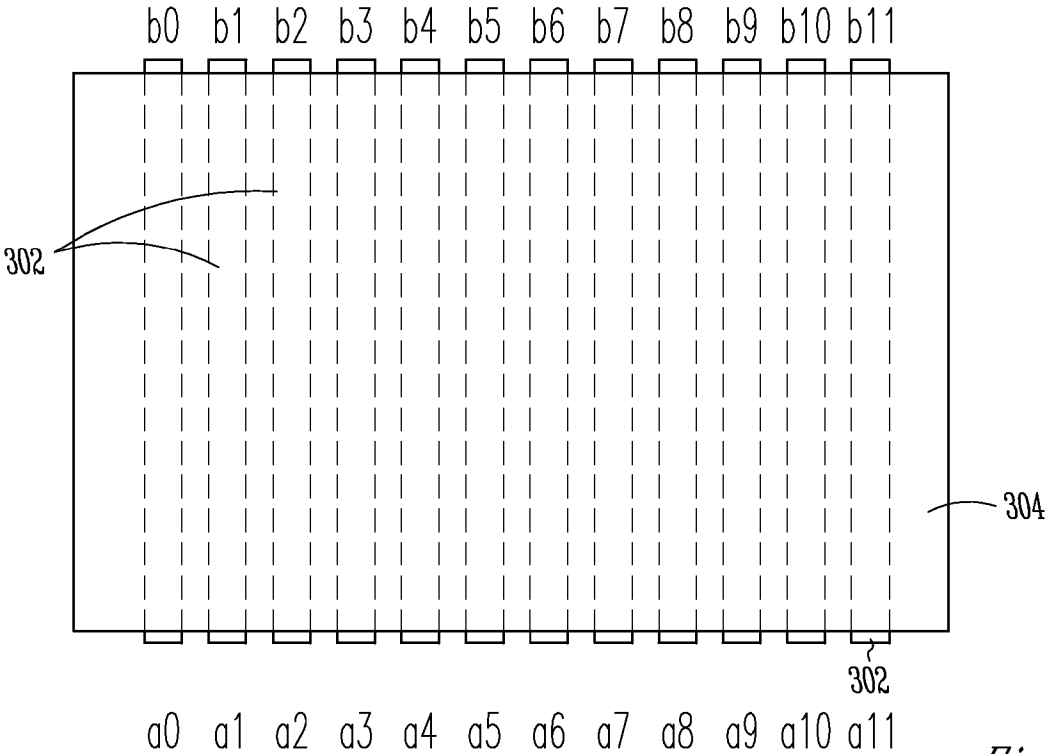
FIGS. 3*a* and 3*b* illustrate the geometry of a transformer according to an embodiment of the present invention.

The geometry or structure of a transformer according to embodiments of the present invention is illustrated in FIG. 3*a*.

FIG. 3*a* provides a simplified top view of a transformer integrated on a die. In one layer, lines (conductors) 302 in FIG. 3*a* are formed parallel to each other by standard silicon processing techniques. Magnetic material 304 is deposited above and below parallel lines 302, and around the leftmost and rightmost parallel lines to form a closed magnetic circuit (see FIG. 3*b*), so as to provide a large inductance and magnetic coupling among the lines. This increases magnetic coupling between the windings of the transformer for a given size of transformer. For simplicity, FIG. 3*a* shows magnetic material 304 only above lines 302.

Figure 3B:
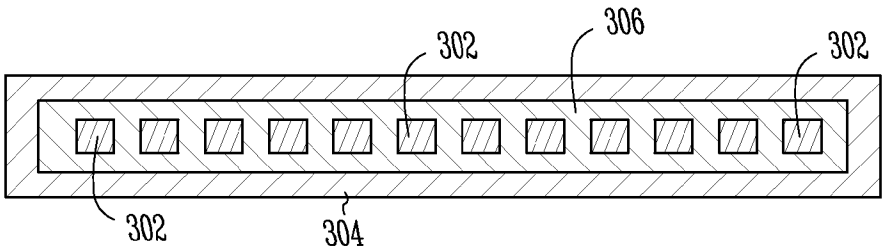
Figure 3C:
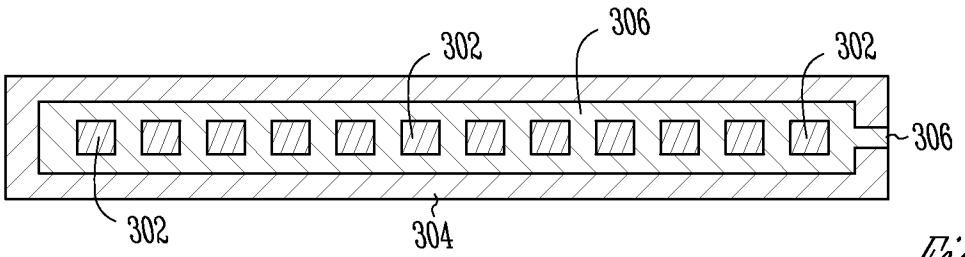
FIG. 3*c* illustrates the geometry of a transformer according to another embodiment of the present invention.

FIG. 3*b* provides a simplified cross-sectional view of a transformer according to embodiments of the present invention. Lines 302 in FIG. 3*b* are insulated from each other and from magnetic material 304 by insulator 306, which may be $SiO_2$, for example. As discussed above, magnetic material 304 in FIG. 3*b* is seen to be deposited both below and above lines 302, as well as around the leftmost and rightmost lines. In other embodiments, a small gap may be fabricated between the top and bottom magnetic layers. For example, FIG. 3*c* shows a gap 306 in magnetic material 304 near the rightmost (with respect to the perspective view) line so that magnetic layer 306 does not completely surround lines 302. Other embodiments may have a gap in the magnetic material near both the leftmost and rightmost lines. This results in a higher saturation current.

Insulating material 306 deposited around lines 302, and in any end gap in magnetic material 304 if present, should have a smaller magnetic permeability than that of magnetic material 304. Otherwise, the magnetic coupling between the lines may degrade. For example, the relative permeability of magnetic material 304 may be greater than 100 and the relative permeability of insulator 306 may be close to one.

Forming lines 302 within one layer, as shown in the embodiment of FIGS. 3*a*, 3*b* and 3*c*, reduces the number of metal levels needed, and reduces capacitance between lines 302 when compared to forming lines on top of each other.

Figure 4:
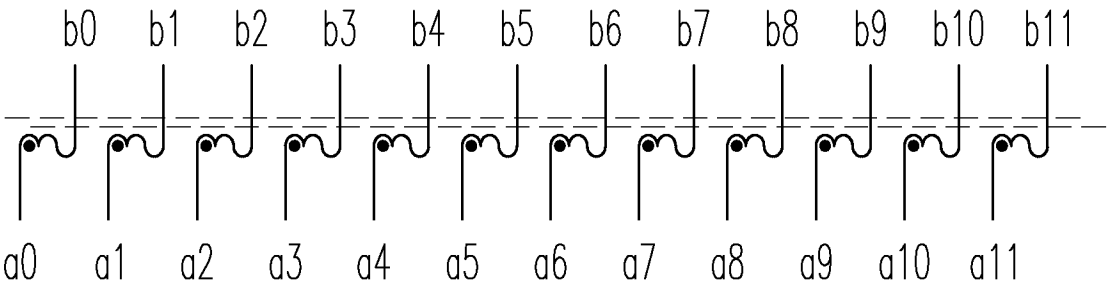
FIG. 4 is a circuit model of the transformer of FIGS. 3*a* and 3*b*.

For simplicity, FIGS. 3*a*, 3*b*, and 3*c* shows only twelve parallel lines, and they do not show the die substrate, other layers, and interconnects. A simplified circuit model for the transformer of FIGS. 3*a* and 3*b* (or the embodiment of 3*c*) is provided in FIG. 4. The magnetic coupling between any two lines decreases with increasing distance between the two lines.

According to embodiments of the present invention, subsets of lines 302 are used to form windings, where the lines belonging to any one subset of lines are connected in parallel to each other. For some embodiments, there is a one-to-one correspondence between a subset and a winding. That is, each subset of parallel connected lines forms a unique transformer winding. For other embodiments, one or more subsets of lines may be connected in series with each other to form a winding of higher inductance. In either case, the windings thereby formed are smaller in number than the number of available lines. The subsets of lines 302 are chosen such that no two lines belonging to any one subset are nearest neighbors. Another way of stating this is that lines that are nearest neighbors belong to different subsets. Two lines are said to be nearest neighbors when there are no other lines in between them.

Figure 5:
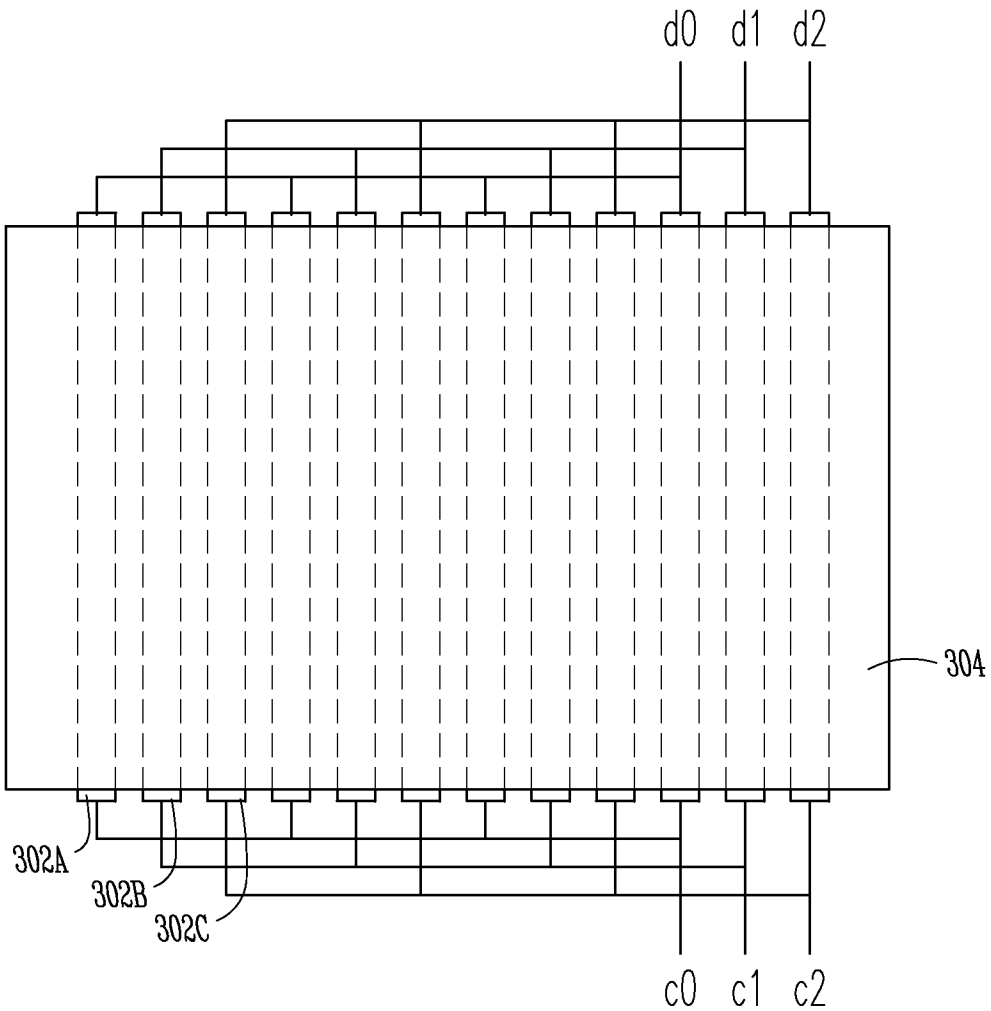
FIG. 5 illustrates connections to realize a transformer with three windings according to an embodiment of the present invention.

As an example of connecting lines to form the windings of a transformer, FIG. 5 provides one example of a transformer having three windings formed from the twelve lines of FIG. 3. A first winding is defined by the path between $d_0$ and $c_0$, a second winding is defined by the path between $d_1$ and $c_1$, and a third winding is defined by the path between $d_2$ and $c_2$. It has been found by simulation that coupling coefficients among any two of the three windings in a transformer according to an embodiment of the present invention may be as high as 95%, and in some cases, higher than 98%, despite the fact that the coupling of any two individual lines may be as poor as 10%. It has also been found that coupling coefficients between any two windings according to an embodiment of the present invention are better when compared to an embodiment utilizing windings formed by connecting in parallel lines that are wider but fewer in number. For example, for a given area, the embodiment of FIG. 5 provides better magnetic coupling than the case in which every four adjacent lines are combined into a wider line, where each wider line forms a winding.

Figure 6:
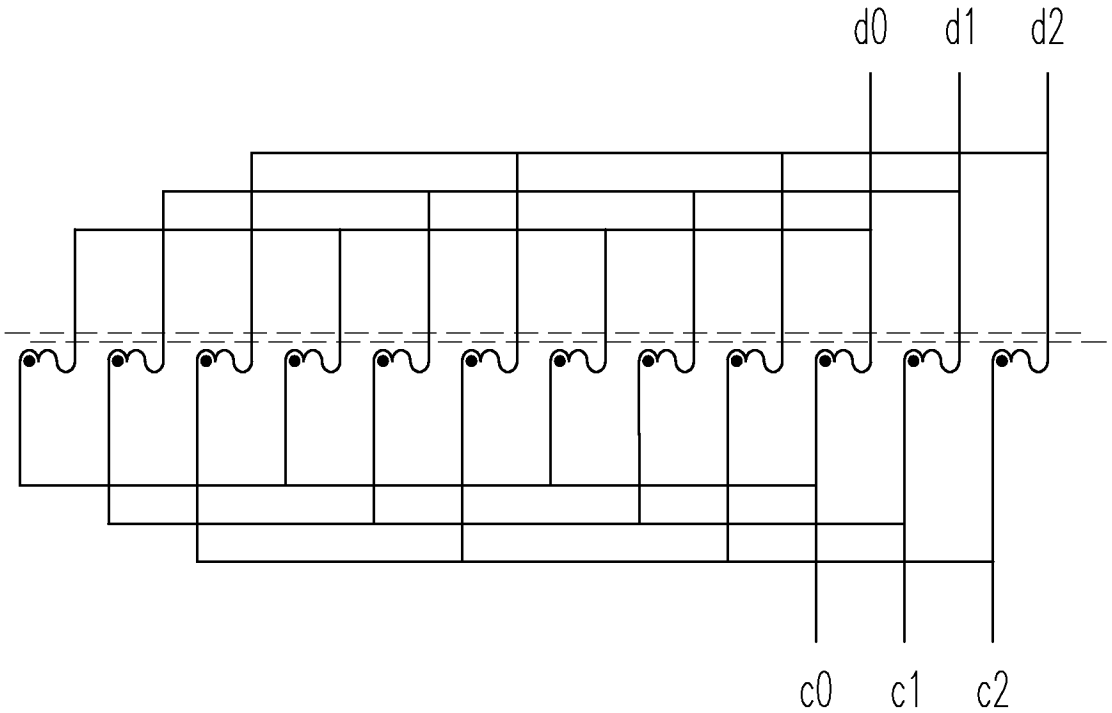
FIG. 6 is a circuit model of the transformer of FIG. 5.

As seen in FIG. 5, the lines are grouped into three subsets, where no two lines belonging to any one subset are nearest neighbors. Each subset corresponds to a unique winding. For example, lines 302*b* and 302*c* in FIG. 5 are nearest neighbors, but they do not belong to the same winding (subset). A simplified circuit model of FIG. 5 is shown in FIG. 6. In particular, every third line in FIG. 5 starting from the leftmost line is connected in parallel to form a first subset, every third line starting from the first line to the right of the leftmost line is connected in parallel to form a second subset, and every third line starting from the second line to the right of the leftmost line is connected in parallel to form a third subset. This approach to choosing subsets of parallel connected lines may be generalized to an arbitrary number of lines as follows: For an arbitrary number of lines $n>1$, denoted as line(i), $i=0, 1, \ldots, n-1$, choose $m>1$ subsets, denoted as subset(j), $j=0, 1, \ldots, m-1$, where for each $i=0, 1, \ldots, n-1$, line(i) belongs to subset(i modulo m), where all the lines in any one subset are connected in parallel to each other.

Note that the latter expression is more narrow than the earlier stated property that no two lines belonging to any one subset are nearest neighbors. That is, if line(i) belongs to subset(i modulo m) for each i, then no two lines belonging to any one subset are nearest neighbors. However, the converse is not necessarily true.

In the case of FIG. 5, $i=12$ and $m=3$, and each subset corresponds to a unique winding. For other embodiments, i and m will assume different values where $m<i$, and some of the subsets may be connected in series to form a winding.

The connections among the various lines making up the windings may be connected by way of another metal layer (not shown) above or below the lines, or may be made by starting and ending the lines on metal pads, and connecting the metal pads among each other by bonding wires or package traces to realize the desired windings.

Various modifications may be made to the disclosed embodiments without departing from the scope of the invention as claimed below. For example, in some embodiments, lines 302 need not be linear or parallel. Furthermore, it is to be understood in these letters patent that the phrase "A is connected to B" means that A and B are directly connected to each other by way of an interconnect, such as metal or polysilicon. This is to be distinguished from the phrase "A is coupled to B", which means that the connection between A and B may not be direct. That is, there may be an active device or passive element between A and B.

What is claimed is:

1. A die comprising:

a transformer including windings formed from a set of lines, the lines formed within one layer on the die, wherein the lines are arranged in parallel with each other, and no two lines in the set of lines belonging to any one winding among the windings are nearest neighbors.

2. The die of claim 1, further comprising a magnetic material located near the set of lines, wherein the magnetic material includes an alloy of cobalt.

3. The die of claim 1, further comprising a magnetic material located near the set of lines, wherein the magnetic material includes CoZrTa.

4. The die of claim 1, further comprising a magnetic material located near the set of lines, wherein the magnetic material includes CoZrTa, CoFeHfO, CoAlO, FeSiO, CoFeAlO, CoNbTa, or CoZr.

5. The die of claim 1, wherein the set of lines includes n>1 lines denoted as line(i), i=0, 1, . . . , n−1, and the transformer includes m>1 windings denoted as winding (j), j=0, 1, . . . , m−1, wherein line(i) belongs to winding(i modulo m).

6. The die of claim 1, further comprising a magnetic material surrounding the set of lines except for the ends of the set of lines.

7. The die of claim 1, further comprising a magnetic material surrounding the set of lines except for ends of the set of lines and except for a gap near the rightmost line in the set of lines.

8. A die comprising:

lines formed within one layer of the die, the lines arranged to form windings of a transformer, wherein two lines that are nearest neighbors belong to two different windings, and no two lines in the lines belonging to any winding among the windings are nearest neighbors.

9. A die comprising:

lines formed within one layer of the die, the lines arranged to form windings of a transformer, wherein two lines that are nearest neighbors belong to two different windings, wherein a number of the windings is equal to a number of the lines.

10. The die of claim 8, further comprising a magnetic material located near the lines, wherein the magnetic material includes CoFeHfO.

11. The die of claim 10, wherein the magnetic material is located below and above the lines.

12. The die of claim 11, further comprising an insulator, such that the lines are insulated from the each other by the insulator.

13. A die comprising:

lines arranged in parallel with each other and formed within one layer of the die, the lines arranged in sub-sets to form windings of a transformer, each of the sub-sets including at least one of the lines to form one of the windings, and no two lines in the set of lines belonging to any one winding among the windings are nearest neighbors; and a controller coupled the transformer.

14. The die of claim 13, wherein the controller is to operate the transformer at a frequency greater than 10 MHz.

15. A die comprising:

lines arranged in parallel with each other and formed within one layer of the die, the lines arranged in sub-sets to form windings of a transformer, each of the sub-sets including at least one of the lines to form one of the windings, wherein no two lines in each of the windings are nearest neighbors: and a controller coupled the transformer.

16. The die of claim 13, wherein at least one of the windings is formed from at least two different lines of one of the sub-sets.

17. The die of claim 13, wherein a number of the windings is less than a number of the lines.

18. The die of claim 13, further comprising a magnetic material located near the lines, wherein the magnetic material includes CoAlO.

19. The die of claim 18, wherein the magnetic material is located on at least one side of the lines.

20. The die of claim 19, further comprising an insulator located between the lines and the magnetic material.

* * * * *